US011124988B1

(12) United States Patent
Hanson

(10) Patent No.: US 11,124,988 B1
(45) Date of Patent: Sep. 21, 2021

(54) ELECTRONIC RIM CYLINDER CABINET DOOR AND DRAWER LOCK

(71) Applicant: Olympus Lock, Inc., Lynnwood, WA (US)

(72) Inventor: Carlton E. Hanson, Seattle, WA (US)

(73) Assignee: Olympus Lock, Inc., Lynnwood, WA (US)

( * ) Notice: Subject to any disclaimer, the term of this patent is extended or adjusted under 35 U.S.C. 154(b) by 0 days.

(21) Appl. No.: 16/254,422

(22) Filed: Jan. 22, 2019

(51) Int. Cl.
*E05B 9/08* (2006.01)
*E05B 55/00* (2006.01)
*E05B 65/46* (2017.01)

(52) U.S. Cl.
CPC ..... *E05B 9/084* (2013.01); *E05B 55/005* (2013.01); *E05B 65/46* (2013.01)

(58) Field of Classification Search
CPC ..... E05B 9/084; E05B 55/005; E05B 65/46; E05B 9/08; E05B 15/02; E05B 65/0025; E05B 9/00; E05B 65/0089
USPC ..... 70/85, 451, 452, 448, 449, 466
See application file for complete search history.

(56) References Cited

U.S. PATENT DOCUMENTS

| | | | | | |
|---|---|---|---|---|---|
| 2,046,630 | A * | 7/1936 | Jacobi | E05C 1/16 | 70/81 |
| 4,899,563 | A * | 2/1990 | Martin | E05B 9/084 | 70/367 |
| 5,560,234 | A * | 10/1996 | Ross | E05B 21/00 | 70/352 |
| 5,657,652 | A * | 8/1997 | Martin | E05B 55/12 | 70/85 |
| 8,495,898 | B2 * | 7/2013 | Gokcebay | G07C 9/00666 | 70/214 |
| 10,697,203 | B1 * | 6/2020 | Gokcebay | E05B 63/0056 | |
| 10,711,489 | B1 * | 7/2020 | Zhang | G07C 9/00309 | |
| 10,851,563 | B1 * | 12/2020 | Zhang | E05B 13/002 | |
| 10,909,789 | B2 * | 2/2021 | Gokcebay | E05B 47/06 | |
| 2003/0056557 | A1 * | 3/2003 | Squier | G07C 9/00896 | 70/278.1 |
| 2008/0060401 | A1 * | 3/2008 | Ramsauer | E05C 3/042 | 70/370 |
| 2010/0180651 | A1 * | 7/2010 | Andersson | E05B 47/068 | 70/449 |
| 2016/0083978 | A1 * | 3/2016 | Dayanikli | E05B 65/46 | 70/85 |

* cited by examiner

*Primary Examiner* — Suzanne L Barrett
(74) *Attorney, Agent, or Firm* — Lowe Graham Jones PLLC

(57) ABSTRACT

An electronic rim cylinder door or cabinet door and drawer lock utilizes third party electronic rim cylinders to drive a dead bolt or latch bolt cabinet door or drawer lock. The lock portion is in kit form and may be adapted to a variety of third party electronic rim cylinders.

8 Claims, 4 Drawing Sheets

ELECTRONIC RIM CYLINDER CABINET DOOR AND DRAWER LOCK

TECHNICAL FIELD

The invention relates to cabinet door and drawer locks. More specifically, the invention relates to an adaptor kit for electronic rim cylinders for integration with dead bolt and latch bolt cabinet door and drawer locks.

BACKGROUND OF THE INVENTION

There are two basic families of cabinet drawer and door locks: deadlocking and latch locking types of locks; and cam-type locks. Both families of locks are used on cabinet drawers and doors such as those found on office desks, credenzas, and interior cabinetry. In the former family, an elongated bolt moves in a reciprocating manner into and out of a bolt housing between locked and unlocked positions, respectively, upon actuation of a key. In the latter family, an elongated bolt moves along an arcuate path, between locked and unlocked positions. In the cam family of locks, an angular rotation of 90 degrees is typically sufficient to determine the locked and unlocked positions. In contrast to cam type locks, deadlocking and latch locking types of locks have a bolt that reciprocates transversely with respect to a keyway of the lock. In the deadlocking type of lock, the bolt remains in an extended or retracted position and is not translatable therefrom without operation of the key. In a latch locking type of lock, the bolt has a curvature on the end thereof and is spring-biased to the extended position. Transverse pressure on the curved portion of the bolt urges the bolt against the spring bias to a retracted position so that a cabinet door or drawer can be closed without the use of a key. The latch locking type of cabinet lock can also be provided with a separate deadlocking bolt that prevents "jimmying" of the spring-biased latch bolt when the deadlocking portion of the latch bolt is depressed, such as by a strike plate. An example of a rekeyable pin tumbler type of deadlocking cabinet lock is shown in U.S. Pat. No. 4,899,563, assigned to the Frank J. Martin Company, Seattle, Wash.; an example of a deadlocking, self-latching cabinet door and drawer deadlocking latch lock is shown in U.S. Pat. No. 5,657,652, assigned to the same assignee. While cabinet door and drawer locks may be found in consumer products such as desks, a large portion of cabinet door and drawer lock sales are to institutional customers such as schools, hospitals, casinos and the like. Security at such institutions is paramount to controlling access to pharmaceutical products, cash drawers and the like. In the event that security at any one of these facilities is compromised by an untrustworthy employee, all of the locks on all of the cabinet doors and drawers must be rekeyed. The assignee of the present invention is a leader in the production of rekeyable cabinet door and drawer locks employing pin tumblers. In addition, said assignee has also pioneered the use of rim cylinder and plug assemblies, which are commonly used for entry way mortise locks, for adaptation to cabinet door and drawer locks. The '198 patent discussed above is an example of a cabinet latch lock which can accept an interchangeable core cylinder and plug assembly from a rim cylinder lock.

Rim cylinder and plug assemblies themselves in the context of entry way mortise locks have become very advanced so as to include electronic versions in which the key to such locks incorporates RFID components as an interface with the mortise/rim cylinder electronics. In this way, all of the entry way doors of a facility provided with rim cylinder mortise entry way locks can be electronically reprogramed. Intellikey Corporation, West Melbourne, Fla. is one manufacturer of such an electronic mortise/rim cylinder entry way lock. Salto Systems, SL, Guipuzcoa, Spain also manufactures an electronic mortise cylinder (model number XS4 GEO) which is specially designed to fit doors that are equipped with a mortise lock that accepts a mortise lock cylinder. The Salto electronic mortise cylinder utilized RFID cards as a key and each cylinder can be reprogramed remotely for recognizing differently programed cards. Therefore, a need exists for an electronic rim cylinder cabinet door and drawer conversion kit which can adapt an electronic rim cylinder to a dead bolt or latch bolt cabinet door and drawer lock.

BRIEF SUMMARY OF THE INVENTION

It is therefore an object of the present invention to provide an electronic rim cylinder cabinet door and drawer conversion kit which can adapt an electronic rim cylinder to a dead bolt or latch bolt cabinet door and drawer lock.

The invention achieves the above objects, and other objects and advantages which will become apparent from the description which follows, by providing a cabinet door and drawer conversion kit for electronic mortise lock rim cylinders including a substantially circular bolt driver having a forwardly and axially directed arbor adapted for receipt of a cam driving spade, and an axially directed bolt driver pin. The kit includes a bolt configured for receiving the drive pin and a main housing for reciprocal receipt of the bolt. A front side of the main housing has a central aperture for rotary receipt of part of the bolt driver. The kit includes a back plate adapted for closing a back side of the housing including, in one preferred embodiment, upper and lower transverse slots positioned for registration with rebates on the main housing for reciprocal receipt of the bolt. An adaptor plate is configured to cover the front of the main housing and has a centrally located bearing in the form of an aperture for receiving the bolt driver arbor. The adaptor plate is configured to allow axially mounting the electronic rim cylinder thereto.

In preferred embodiments of the invention, the bolt is a dead bolt and the back plate includes a lower transverse slot solution for registration with a lower rebate on the main housing for reciprocal receipt of the bolt therein. In an alternate embodiment, the bolt is a spring biased dead latch. In either embodiment, set screws are provided to secure the back plate to the main housing. A spacer plate is preferably provided which has a central aperture for receipt of the rim cylinder for matching a length of the rim cylinder to a thickness of a cabinet door or drawer to which the lock is to be mounted. An annular rotary bezel is sized to cover a lip portion of the rim cylinder to prevent the rim cylinder from being rotated, such as by a wrench. The main housing, adaptive plate and the spacer plate backplate are all configured to align with one and other and have mounting holes in registration with one and other so that mounting screws may be passed through the mounting holes to secure the lock to an inside surface of the cabinet door or drawer.

DETAILED DESCRIPTION OF THE PREFERRED EMBODIMENTS

Figures 1, 2:
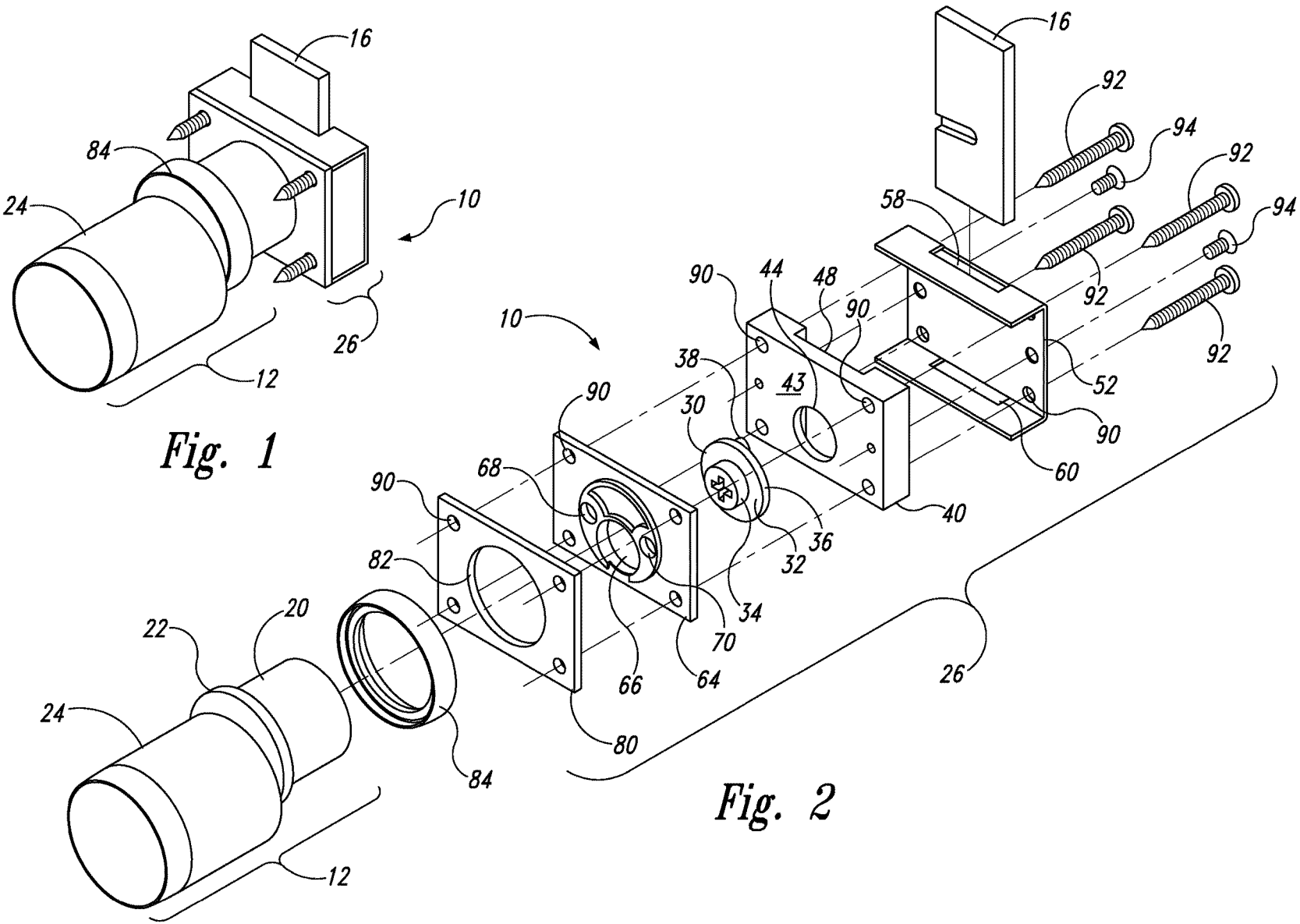
FIG. 1 is a perspective view of an electronic rim cylinder cabinet door and drawer lock employing the principals of the invention.
FIG. 2 is an exploded, front perspective view of the lock shown in FIG. 1.
Figure 3:
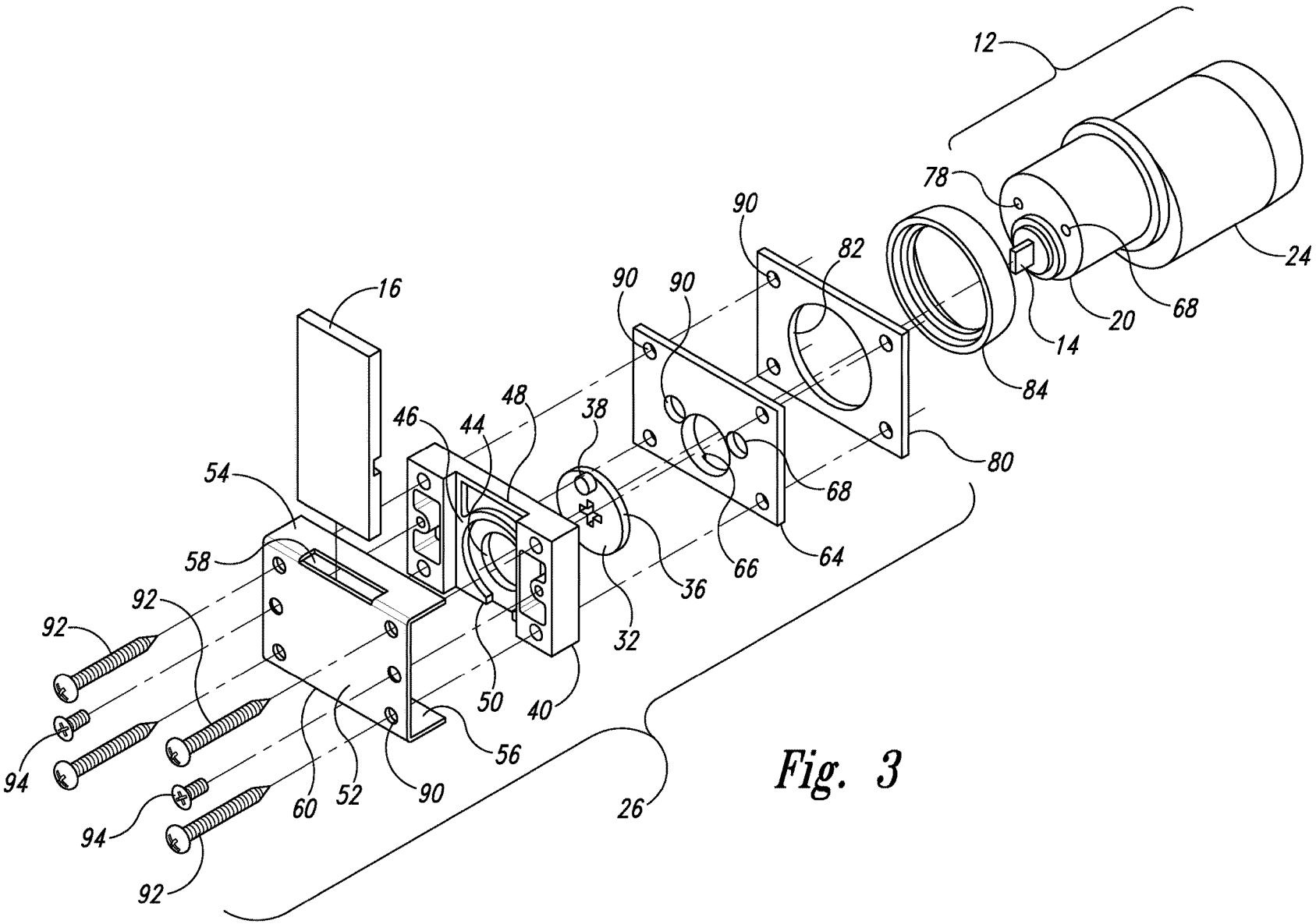
FIG. 3 is an exploded rear perspective view of the lock shown in FIG. 2.

An electronic rim cylinder door and drawer lock in accordance with the principles of the invention is generally indicated at reference numeral 10 in the various Figures of the attached drawings wherein numbered elements in the Figures correspond to like numbered elements herein. The lock, 10, utilizes an electronic rim cylinder, 12, which has the ability to actuate a tail piece or spade, 14 (best seen in FIG. 3), so as to retract or extend a dead bolt, 16, which will be described further herein below. The exemplary electronic rim cylinder, 12, is manufactured by Salto Systems, S.L. Guipuzcoa, Spain (Model XS4) in accordance with American National Standards Institute (ANSI) standards. The lock, 10, depicted in the various Figures is capable of being adapted to electronic mortise or rim cylinders manufactured by a wide variety of companies including model RC6-SC-626-KA2 made by General Lock San Diego Calif.; American Lock (model numbers WEI-636-10-079); Medeco (models MAD-10-400-z626 and MAD-10-40-3d626); Ambloy, Joensw, Finland (model ABLOY-CY-415t626); Various Corbin/Ruusmin, Berlin, Connecticut models; ASSA (asa6515ul625); various models from Schlage Colorado Springs, Colorado; Miwa Lock, Tokyo Japan (model mwarim32); Sargent Lock, New Haven, Conn.; and Aero Lock Salem Virginia. In the exemplary rim cylinder, 12 shown in the Figures, the rim cylinder has a cylindrical rearward portion, 20, having an expanded diameter, circumferential lip 22 at a forward end thereof, and a cylindrical forward, off-set portion 24 housing the electronics and battery which actuate the lock mechanism inside the rearward portion 20. The Salto electronic rim cylinder 12 is actuated by an RFID card (not shown) and may be electronically reprogramed in a variety of ways so as to render the entire lock 10 rekeyable with electronic commands. The kit portion 26 of the lock 10 is shown in exploded view in FIGS. 2 and 3. The kit includes a bolt driver 30 having a radially extending circumferential disc portion 32 supporting a forwarding and axially extending arbor 34 adapted to receive the spade portion 14 of the electronic rim cylinder 12. The disk portion forms a circumferential, peripheral bearing surface 36 and a rearwardly and axially directed bolt driver pin 38 for driving the bolt 16. The kit 26 further includes a casting or main housing 40 having a front surface 43 defining an aperture 44 for receipt of the bearing surface 36 of the arbor 34. A rear side 46 of the housing 40 has upper and lower rebates 48, 50 for reciprocal receipt of the dead bolt 16. The rear side 46 of the main housing 40 is closed by a back plate 52 having upper and lower extensions 54,56 defining upper and lower slots 58,60 registerable with the rebates 43,50 to permit the deadbolt 16 to reciprocate into and out of the main housing 40.

The kit 26 further includes an adaptor plate 64 configured to cover the front surface 43 of the main housing 40. The adaptor plate has a central aperture 66 for registration and receipt of the arbor 34 on the bolt driver 30. Thus, the bolt driver is supported for rotary motion by both the arbor 34 and aperture 66 on the adaptor plate 64 as well as the bearing surface 36 on the disk portion 32 which is supported by the aperture 34 in the main housing 40. The adaptor plate also contains a pair of bores 68,70 which correspond with bores 68' and 70' on a rear surface of the rearward portion 20 such that the electronic rim cylinder 12 can be secured through the adaptor plate 64 by pan head screws (not shown). Number 12-24 UNC Philips pan head screws are adequate to secure the Salto electronic rim cylinder model G9B1 GEO to the adaptor plate. Those of ordinary skill in the art will conceive of other adaptations and modifications to the adaptor plate 64 for mounting electronic rim cylinders 12 manufactured by other companies. Typically the only variation necessary is the distance between bores 68 and 70. In order to properly position the bolt 16 behind a strike plate (not shown) of a cabinet door or drawer the lock 10 is provided with a spacer plate 80 having a central aperture 82 sized to accept the cylinder rearward portion 20. A thickness of the spacer plate 80 is selected, or multiple spacer plates are used such that the rim 22 of the rearward portion 20 is covered by the rotating bezel 84 when the cabinet door or drawer is interposed between the awning plate 80 and the bezel 84.

Each of the back plate 52, main body 40, adaptor plate 64, and spacer plate 80 are provided with peripheral mounting holes 90 which are all in registration with one and other for receipt of mounting screws 92 to secure the lock 10 to the inner surface of a cabinet door or drawer. Set screws 94 are provided to secure the back plate 52 to appropriate apertures in the rear side 46 of the main body 40.

Figure 4:
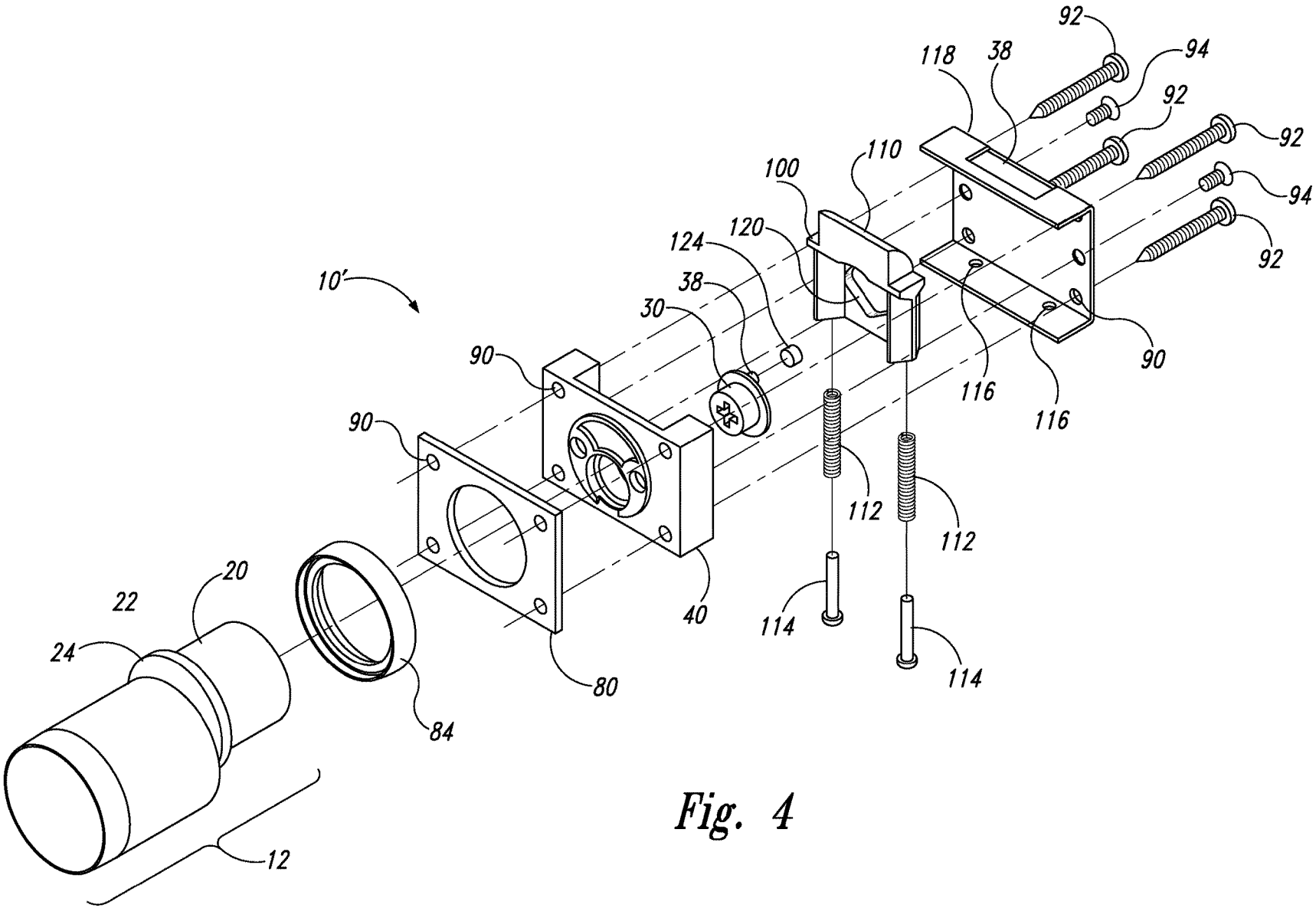
FIG. 4 is an exploded, front perspective view of a latch bolt version of the lock shown in FIGS. 1 through 3.
Figure 5:
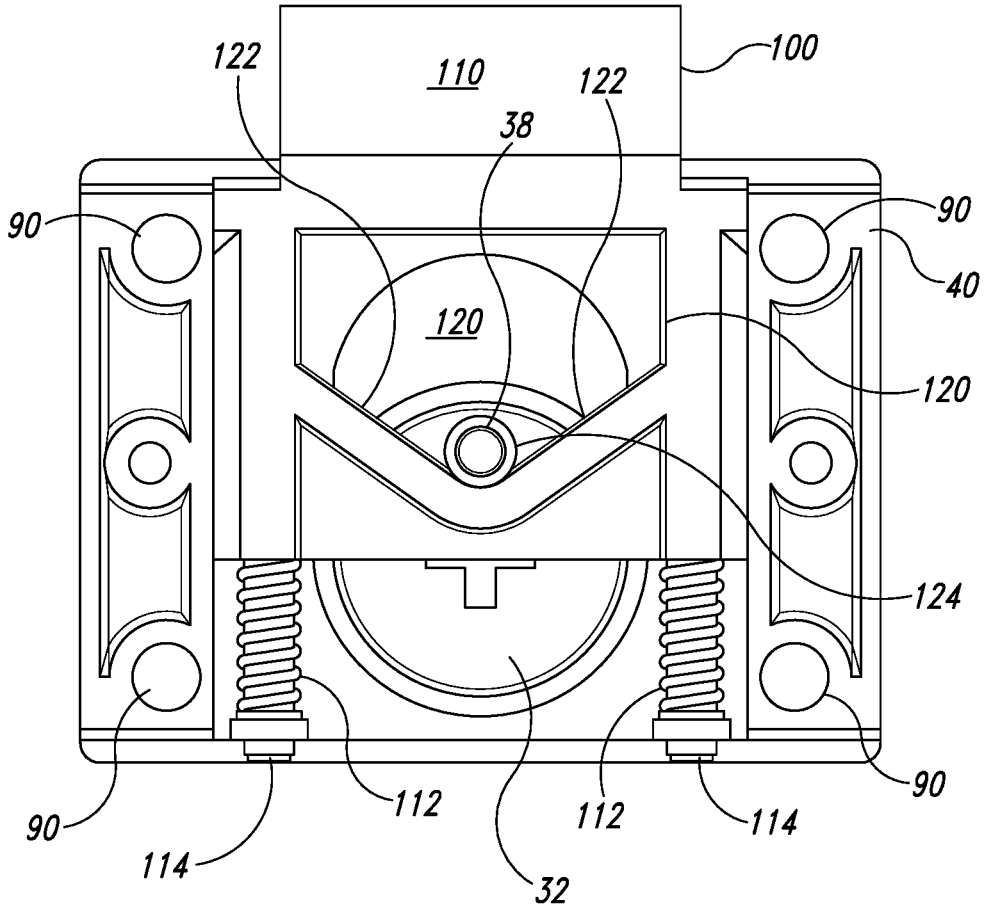
FIG. 5 is a rear elevational view of the latch bolt embodiment of the invention illustrating the interaction of a bolt driver pin of the invention with the latch bolt.

FIG. 4 is an exploded isometric view of an alternate embodiment of the electronic rim cylinder cabinet door and draw lock 10' in which the dead bolt 10 has been replaced with a latch bolt 100. The latch bolt has a curved surface 110 on a rear side thereof such that when the latch bolt encounters a strike or strike surface (not shown) on an adjacent portion of a cabinet the latch will retract against the bias of springs 112 guided on pins 114 located by detents 116 in a modified back plate 118 the modified back plate 118 lacks the lower slot 16 of the back plate 52 in the dead bolt embodiment shown in FIGS. 1-3. As best seen in FIG. 5, of the latch bolt includes a cut-out 120 configured with ramp portions 122 so that rotation of the drive pin 38 in either the clockwise or counterclockwise direction from the twelve o'clock position retracts the bolt 100 against the urgings of the springs 112. The drive pin 38 of the bolt driver 30 is preferably with a friction reducing roller 124.

The electronic rim cylinder cabinet door and drawer lock 10', employing a third party electronic rim cylinder 12 and the kit portion 26 allows and institution such as a school, casino or hospital pharmacy to integrate security of its entryway door mortise locks with its cabinet locks such that all of these security points may be simultaneously reprogramed electronically. The ability to do so substantially reduces maintenance costs associated with rekeying locks of this type in the event of a compromised employee or other security threat.

Those of ordinary skill in the art will conceive of other alternate embodiments of the invention upon reviewing this disclosure. Thus, the invention is not to be limited to the above description, but is to be determined in scope by the claims which follow.

I claim:

1. A cabinet door and drawer lock conversion kit for electronic mortise lock rim cylinders, comprising:

a substantially circular bolt driver having a radially extending circumferential disk portion forming a peripheral bearing surface, the disk portion supporting a rearwardly and axially directed bolt driver pin, and a central, forwardly and axially directed arbor adapted for receipt of a cam driving spade;

a bolt having means for receiving the drive pin;

a main housing having a substantially closed front side and substantially open back side, the front side defining an axially directed central aperture for rotary receipt of the bolt driver bearing surface, the main body further having upper and lower transverse rebates for reciprocal receipt of the bolt and a plurality of peripheral, axially directed mounting apertures;

a back plate adapted for closing the back side of the housing, and defining at least an upper transverse slot positioned for registration with one of the rebates on the main housing for reciprocal receipt of the bolt, and axially directed mounting apertures in registration with the main housing mounting apertures; and, an adapter plate defining mounting apertures in registration with the main body and back plate mounting apertures, configured to cover the front of the main housing and defining a centrally located bearing for the bolt driver arbor, the adapter plate further having means for axially mounting the electronic rim cylinder thereto.

2. The conversion kit of claim 1 wherein the bolt is a dead bolt, and the back plate includes a lower transverse slot positioned for registration with one of the rebates on the main housing for reciprocal receipt of the bolt.

3. The conversion kit of claim 1 wherein the bolt is a spring biased dead latch.

4. The conversion kit of claim 1 including a pair of set screws selected in length to secure the back plate to the main housing.

5. The conversion kit of claim 1 including a spacer plate defining a central aperture for receipt of the rim cylinder for matching a length of the rim cylinder to a thickness of a cabinet door or drawer, and an annular rotary bezel sized to cover a lip portion of the rim cylinder.

6. The conversion kit of claim 5 including a pair of pan head screws having a length selected to secure the rim cylinder to the adapter plate through the adapter plate mounting means.

7. The conversion kit of claim 6 including a plurality of mounting screws selected in length to secure the back plate, main body, adapter plate and spacer plate to an inside surface of a cabinet door or drawer.

8. The conversion kit of claim 1 including a cam driving spade.

* * * * *